US006675511B2

(12) United States Patent
Pines

(10) Patent No.: US 6,675,511 B2
(45) Date of Patent: Jan. 13, 2004

(54) ACOUSTIC CARD

(75) Inventor: Benjamin A. Pines, Rosly Heights, NY (US)

(73) Assignee: Apple Corporate Technologies, Inc., Floral Park, NY (US)

( * ) Notice: Subject to any disclaimer, the term of this patent is extended or adjusted under 35 U.S.C. 154(b) by 8 days.

(21) Appl. No.: 09/838,543

(22) Filed: Apr. 20, 2001

(65) Prior Publication Data

US 2002/0152652 A1 Oct. 24, 2002

(51) Int. Cl.[7] ..... G09F 1/00
(52) U.S. Cl. ..... 40/124.03; 40/906
(58) Field of Search ..... 40/124.03, 455, 40/717, 906; 340/384.1

(56) References Cited

U.S. PATENT DOCUMENTS

| | | | | | |
|---|---|---|---|---|---|
| 3,798,806 | A | * | 3/1974 | Sanford | 40/124.03 |
| 3,928,928 | A | * | 12/1975 | Kalust | 40/124.03 |
| D245,765 | S | | 9/1977 | Yoshida | |
| 4,102,067 | A | * | 7/1978 | Tarrant | 40/455 |
| 4,288,767 | A | | 9/1981 | Lee | |
| D263,124 | S | | 2/1982 | Dennis | |
| D264,821 | S | | 6/1982 | Henkels | |
| 4,434,567 | A | * | 3/1984 | LeVeau | 206/473 |
| D277,556 | S | | 2/1985 | Pappas | |
| 4,611,262 | A | | 9/1986 | Galloway et al. | |
| 4,618,823 | A | | 10/1986 | Dahlheimer et al. | |
| 4,703,573 | A | * | 11/1987 | Montgomery et al. | 40/124.03 |
| 4,709,493 | A | | 12/1987 | Sapp | |
| 4,861,505 | A | * | 8/1989 | Farman | 206/77.1 |
| 4,910,634 | A | | 3/1990 | Pipkorn | |
| 4,997,126 | A | | 3/1991 | Amoss | |
| 5,063,698 | A | | 11/1991 | Johnson et al. | |
| 5,254,879 | A | | 10/1993 | Jackson | |
| 5,275,285 | A | | 1/1994 | Clegg | |
| 5,280,961 | A | | 1/1994 | Rohloff | |
| 5,311,168 | A | * | 5/1994 | Pease et al. | 200/61.93 |
| 5,435,085 | A | | 7/1995 | Johnson | |
| 5,552,774 | A | | 9/1996 | Gridley | |
| 5,576,678 | A | * | 11/1996 | Saunders | 335/205 |
| 5,595,008 | A | | 1/1997 | Johnson | |
| 5,639,093 | A | * | 6/1997 | Law et al. | 273/140 |
| 5,761,836 | A | * | 6/1998 | Dawson | 283/117 |
| 5,778,574 | A | * | 7/1998 | Reuben | 40/124.03 |
| 5,782,357 | A | | 7/1998 | Johnson | |
| 5,864,288 | A | * | 1/1999 | Hogan | 340/332 |
| 6,104,306 | A | * | 8/2000 | Hogue et al. | 200/332 |
| 6,118,986 | A | * | 9/2000 | Harris et al. | 235/441 |
| 6,212,052 | B1 | | 4/2001 | Heuer et al. | |
| 6,314,183 | B1 | * | 11/2001 | Pehrsson et al. | 379/433.06 |

* cited by examiner

*Primary Examiner*—William L. Miller
(74) *Attorney, Agent, or Firm*—Robert E. Bushnell, Esq.

(57) ABSTRACT

An acoustic card having a permanent magnet and a reed switch. The acoustic card includes a first flap, a second flap, and a sound generator attached to said second flap. The acoustic card is divided by a fold into two halves, such as the first flap and the second flap, is unfolded in an opened position and folded in a closed position. The sound generator attached to the second flap includes a printed circuit board, a sound card containing a controller and a memory storing audio sound data, and the reed switch. A permanent magnet attached to the first flap does not directly contact the reed switch attached to the second flap. The permanent magnet moves away from the reed switch to activate the sound generator to produce audio sound and moves towards the reed switch to deactivate the sound generator.

21 Claims, 5 Drawing Sheets

ACOUSTIC CARD

BACKGROUND OF THE INVENTION

1. Field of the Invention

The present invention generally relates to sound generating novelty greeting cards and processes, and more particularly, to a process and circuit for controlling operation of the sound generator carried by greeting cards.

2. Description of the Background Art

Business cards having various types and configurations of sound generators are still not that well known, and remain a novelty item. Typically, the sound generator is attached to the inside of a folded card such as a greeting card, an announcement or a business card. Usually, the card includes a sound emitting device and a switch that activates the sound emitting device. The switch is provided with a pair of contacts that are held electrically open by a tongue mechanism that is positioned between the contacts of the switch. When the business card is in an open position, movement of the tongue mechanism during the opening of the card allows the contacts of the switch to close in order to electrically activate the sound emitting device to produce audio sound. If the business card is in a closed position however, the contacts of the switch are held apart by the tongue so that the switch remains in an electrically open state to deactivate the sound emitting device and thereby stop the production of audio sound.

Almost all acoustic cards are folded into two or more surfaces, with a sound generator, battery and speaker mounted on one of the interior surfaces, and an actuator that spans the fold between two adjoining surfaces. Some of these acoustic cards are physically bulky and their actuator tends to become deformed and intermittently inoperable as a result of repeated use. Other models of acoustic cards use electrical actuators that depend upon a tongue that is made of an electrically insulating material, and is connected to an audio sound generator mounted on one side of the card and attached to the surface of the card on the opposite side of the fold. The presence of the sound generator is therefore concealed while the card is folded. Consequently, rough handling, such as opening the card by rotating the two planar interior surfaces more than one hundred and eighty degrees around the fold may destroy the connection of the actuator, frequently allowing the card to become a nuisance by broadcasting sound continuously, even after the interior surfaces have been closed, until the battery has been drained.

Since the contacts of the switch mechanically contact the tongue mechanism, misplacement and distortion of the tongue mechanism will cause a malfunction of both the switch and the sound emitting device when the business card is moved from its open position to its closed position. Moreover, the presence of foreign material between the tongue mechanism and the contacts of the switch, or abrasion of the tongue mechanism and the contacts of the switch, will cause the contacts of the switch to be abruptly opened to interrupt the operation of the sound emitting device or to be unexpectedly closed to allow the sound emitting device to produce audio sound when a user does not want the audio sound. Such unpredictable operation of the sound emitting device destroys the utility of the card long before expiration of the life of the battery that powers the audio generator, and tends to diminish the novelty and merchantability of acoustic cards.

SUMMARY OF THE INVENTION

It is an object of the present invention to provide an improved acoustic card and process for operating an acoustic card.

It is another object to enhance the durability of an acoustic card equipped with a sound generator.

It is still another object to provide an improved acoustic card that is less susceptible to a malfunction of its sound generator.

It is yet another object to provide an acoustic card having an electrical actuator able to avoid abrasion of the contacts of an electrical switch operating the sound generator.

It is still yet another object to provide an acoustic card having a sound generator able to predictably furnish audio sounds during the battery life of the card.

It is a further object to provide an acoustic card equipped with asound generator battery and actuator that is able to repeatedly and predictably broadcast audio sounds during the life of the battery.

It is also an object to provide an acoustic card having a reduced thickness.

These and other objects may be achieved with an acoustic card constructed with a first flap separated by a fold from a second flap, a sound generator driving a speaker, a battery that powers the sound generator, and an actuator incorporating a reed switch attached to the second flap. The first flap and the second flap are mutually rotatable about the fold. A permanent magnet is attached to the first flap at a location selected to place the magnet in sufficient proximity to the reed switch to cause the electrical contacts of the reed switch to switch between an electrically open state and an electrically closed state when rotation of the first flap relative to the second flap either places the magnet adjacent to the electrical contacts or moves the magnet away from proximity to the electrical contacts, to enable the electrical contacts of the reed switch to be closed to activate the sound generator to produce audio sound.

In an alternative embodiment, a first flap is separated by a fold from a second flap, a sound generator driving a speaker, a battery that powers the sound generator, and an actuator incorporating a reed switch are mounted on the second flap. A sliding tongue bearing a permanent magnet is attached to the first flap. The first flap and the second flap are mutually rotatable about the fold. The permanent magnet borne by the tongue attached to the first flap does not directly contact the electrical contacts that are vacuum sealed inside the reed switch and may be spaced apart from the reed switch by the thickness of the electrically insulating tongue. The first flap draws the tongue and the permanent magnet away from the reed switch to enable the electrical contacts of the reed switch to be closed to activate the sound generator to produce audio sound, and slides the tongue to close the reed switch to an electrical open state to deactivate the sound generator and terminate the audio sound. The permanent magnet may be positioned to move along a side of the reed switch so that the thickness of the acoustic card is reduced.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
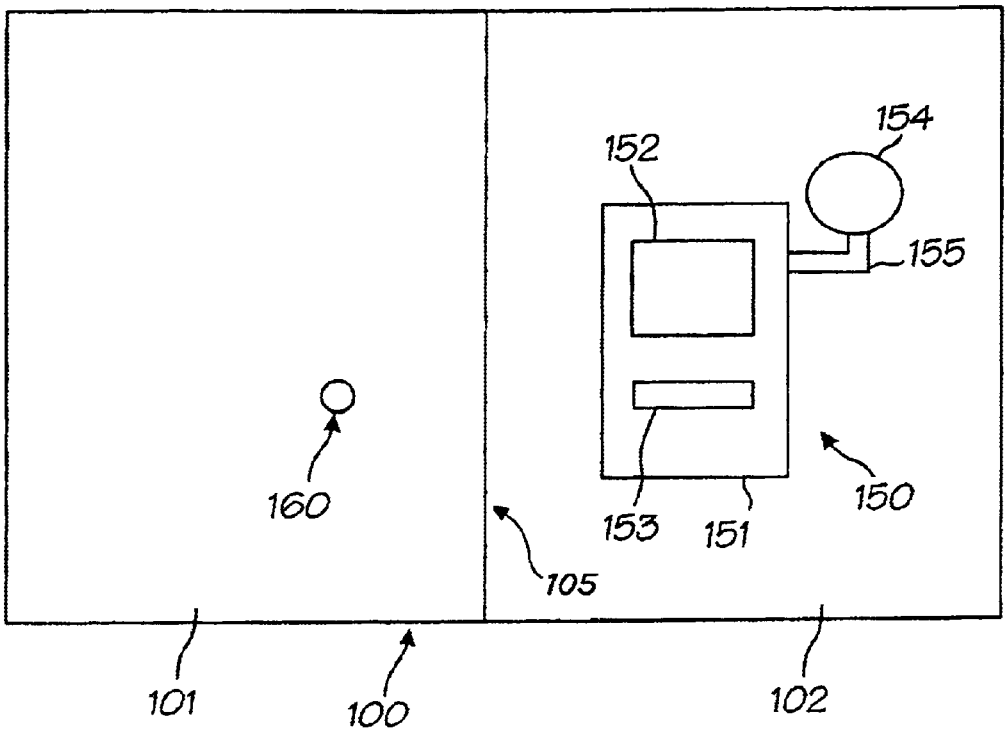
FIG. 1 is a plain view of an acoustic card constructed according to the principle of the present invention.

Referring to the drawings, FIG. 1 illustrates a folded acoustic card 100 having a first flap 101, a second flap 102, and a sound generator 150 attached to second flap 102. Acoustic card 100 may be divided by a fold 105 into two approximately equal planar surfaces, such as first flap 101 and second flap 102, and alternately manipulated into an unfolded state while the flaps 101, 102 are in an open position and into a folded state while flaps 101, 102 are in a closed position. Sound generator 150, which may be constructed as a sound module, includes a printed circuit board (printed circuit board) 151, a sound card 152 that is mounted on printed circuit board 151 contains a controller and a memory, such as a read only memory that stores audio sound data. Alternatively, the audio sound data may be stored in binary form, and applied by the controller to a digital to analog converter driving audio speaker 154 at a frequency that reproduces the audio sound data. Reed switch 153 is mounted on printed circuit board 151 and coupled to sound generator 152, and speaker 154 is coupled to printed circuit board 151 through electrical leads 155. In response to the open and closed states of reed switch 153 that are triggered by movement of magnet 160 relative to the internal electrical contacts of reed switch 153, sound card 152 is powered by battery that is also mounted on circuit board 151, to reproduce the audio sound by using the audio sound data stored in the memory to drive speaker 154, and is deactivated in response to the opposite movement of magnet 160 to terminate reproduction of the audio sound through speaker 154.

Magnet 160 is attached to first flap 101 at a particular location where magnet 160 will be positioned adjacent to reed switch 153 when acoustic card 100 is folded into the closed position. If acoustic card 100 is unfolded into its open position, magnet 160 moves away from reed switch 153, and then the internal electrical contacts of reed switch 153 are closed to enable the flow of electrical energy from the battery to activate sound card 152, thereby producing audio sounds through speaker 154. When acoustic card 100 is folded into the closed position, magnet 160 moves adjacent to reed switch 153 to open (i.e., to electrically separate) the internal electrical contacts of reed switch 153 and to deactivate sound card 152 to stop the reproduction of the audio sound through speaker 154. These audio sounds may alternatively be produced for a predetermined period of time regardless of whether card 100 is folded or unfolded, once reed switch 153 has initially been placed in a closed electrical state to activate sound card 152 by an initial unfolding of acoustic card 100 into its open position.

Although speaker 154 is connected to printed circuit board 151 through electrical leads 155, speaker 154 may be installed on printed circuit board 151. Reed switch 153 is connected to sound card 152 and a battery that may be mounted on printed circuit board 151.

Figure 2:
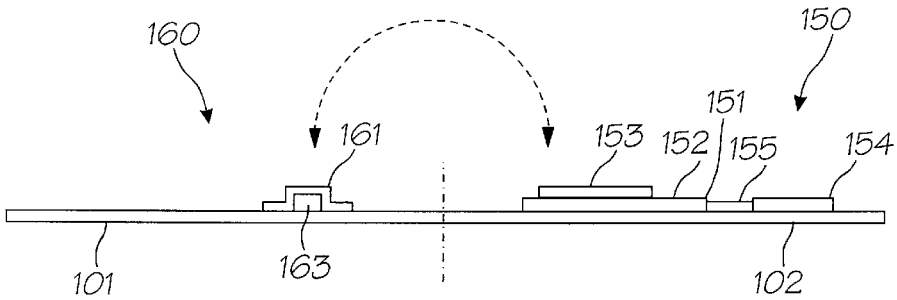
FIG. 2 is a side view of the acoustic card of FIG. 1 in an open position.

FIG. 2 shows a side view of the acoustic card 100 illustrated by FIG. 1. Magnet 160 includes a permanent magnet 163 and a cover 161 that encases permanent magnet 163; magnet 160 is attached to first flap 101. Cover 161 may also be used to attach permanent magnet 163 to first flap 101. Magnet 160 is placed on a predetermined location of first flap 101 so that magnet 160 is disposed adjacent to reed switch 153 to open reed switch 153 when acoustic card 100 is folded into its closed position. When acoustic card 100 is manipulated from its open position into its closed position, magnet 160 moves in the direction of the dotted arrow shown in FIG. 2.

Figure 3:
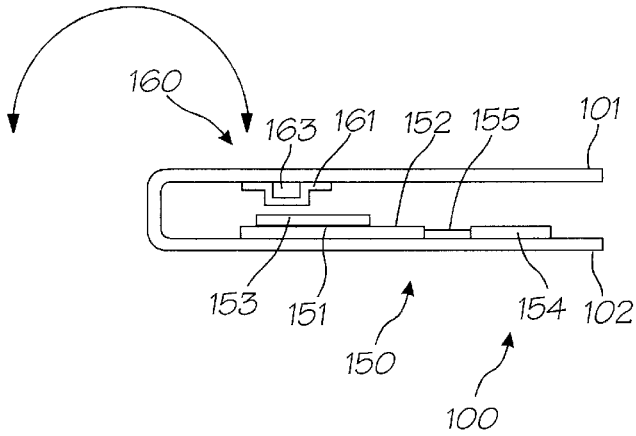
FIG. 3 is a side view of the acoustic card of FIG. 1 in a closed position.

When acoustic card 100 is folded in the direction of the solid arrow from its open position into its closed position as shown in FIG. 3, magnet 160 is disposed over reed switch 153 so that the electrical contacts of reed switch 153 are opened to deactivate sound card 152. Reed switch 153 is located within the magnetic field generated by magnet 160. It is not necessary for permanent magnet 163 to directly contact reed switch 153 since permanent magnet 163 of magnet 160 is spaced apart from reed switch 153 by a predetermined distance when card 100 is in its closed position.

Even if cover 161 of magnet 160 contacts a surface of reed switch 153, permanent magnet 163 of magnet 160 does not need to directly contact the surface of reed switch 153. Moreover, magnet 160 does not need to directly contact any reed of reed switch 153. Normally, these electrical contacts are protectively encased within the vacuum of the glass, or plastic shell of reed switch 153. Permanent magnet 163 is disposed adjacent to reed switch 153 at a place where the reed of reed switch 153 is opened and closed by the magnetic field generated by magnet 160.

Figure 4:
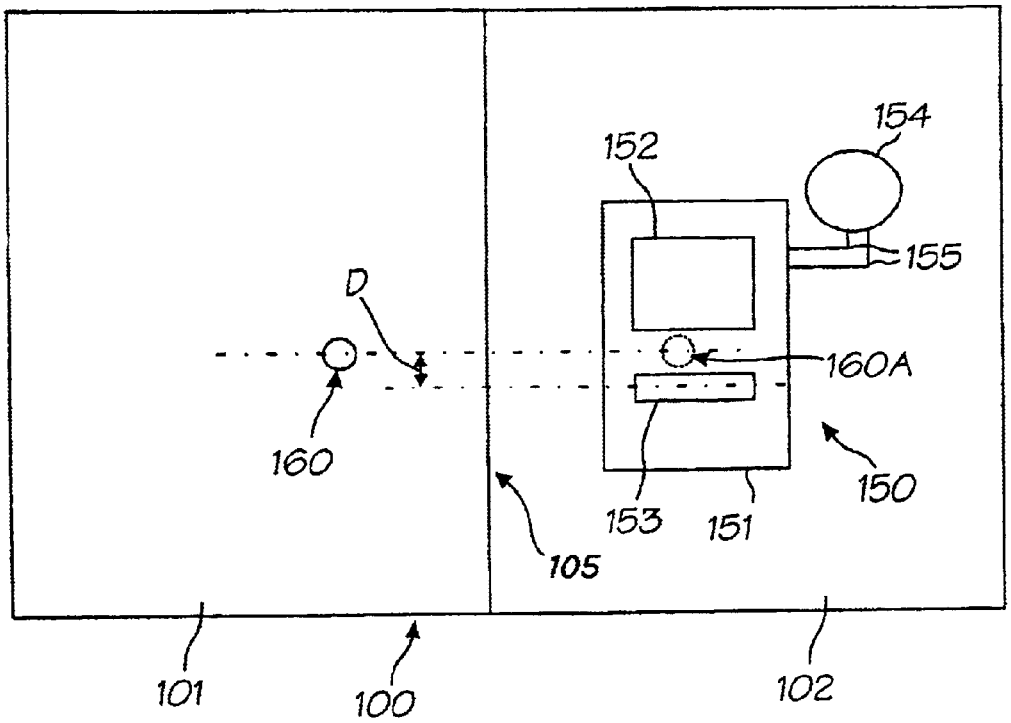
FIG. 4 is a plan view of a second embodiment of a card device constructed according to the principles of the present invention.

In FIG. 4, magnet 160 is attached to a second location of first flap 101 of acoustic card 100 that is different from the location shown in FIG. 1. Magnet 160 is spaced apart from reed switch 153 by a predetermined distance D1 in a direction parallel to fold 105. Magnet 160 is disposed on a corresponding position 160A to be spaced apart from reed switch 153 by the distance D1 in the direction parallel to fold 105 so that reed switch 153 is opened or closed by the magnetic field of magnet 160 when acoustic card 100 is folded into its closed position. The distance D1 between reed switch 153 and magnet 160 when acoustic card 100 is folded into the closed position is close enough for the magnetic field created by magnet 160 to hold reed switch 153 in its electrically opened state.

Figure 5:
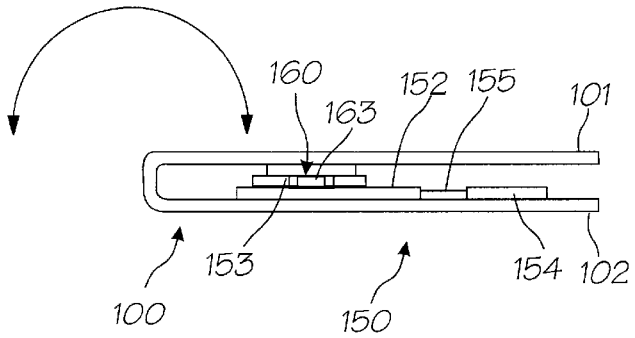
FIG. 5 is a side view of the acoustic card of FIG. 4 in the closed position.
Figure 6:
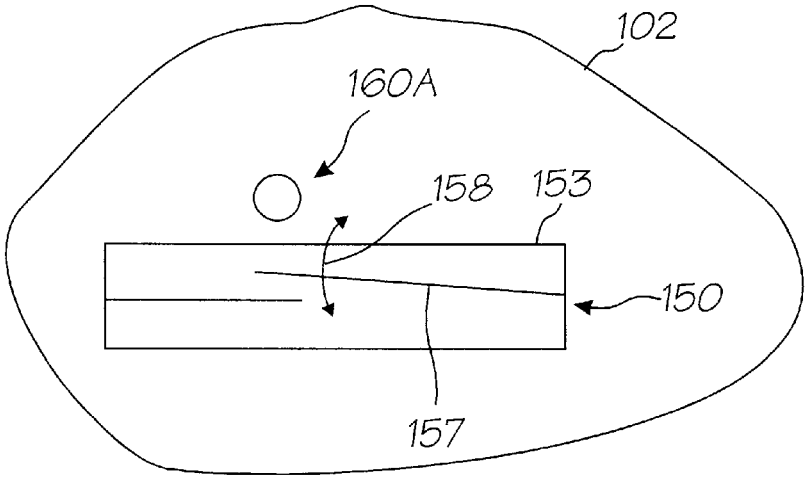
FIG. 6 is a partial plain view showing movement of a reed of a reed switch in response to movement of a magnet shown in FIG. 4.

When acoustic card 100 is in its closed position after moving the arc along represented by the solid arrow shown in FIG. 5, permanent magnet 163 of magnet 160 is disposed adjacent to one side of reed switch 153. Permanent magnet 163 is not located between first flap 101 and reed switch 153, but is placed side by side with reed switch 153 on the surface of second flap 102. FIG. 6 illustrates the direction 158 of movement of the internal electrical reed contacts 157 of reed switch 153 in response to the presence of magnet 160, which is disposed in the corresponding position 160A on second flap 102 when acoustic card 100 is folded into the closed position. Reed 157 moves toward and away from permanent magnetic 163 of magnet 160 and moves in the direction 158 parallel to the surface of second flap 102 of acoustic card 100.

When permanent magnetic 163 is moved away from the side of reed switch 153 by manually unfolding first and second flaps 101, 102 of acoustic card 100 into its open position, reed 157 of reed switch 153 moves in the direction 158 parallel to the surface of second flap 102 to close reed switch 153. When permanent magnet 163 of magnet 160 moves toward the corresponding position 160A close to the side of reed switch 153 by folding the first and second flaps 101, 102 of acoustic card 100 into the closed position, electrical reed contact 157 of reed switch 153 moves in the direction 158 parallel to the fold 105 between first and second flaps 101, 102 to open reed switch 153.

Figure 7:
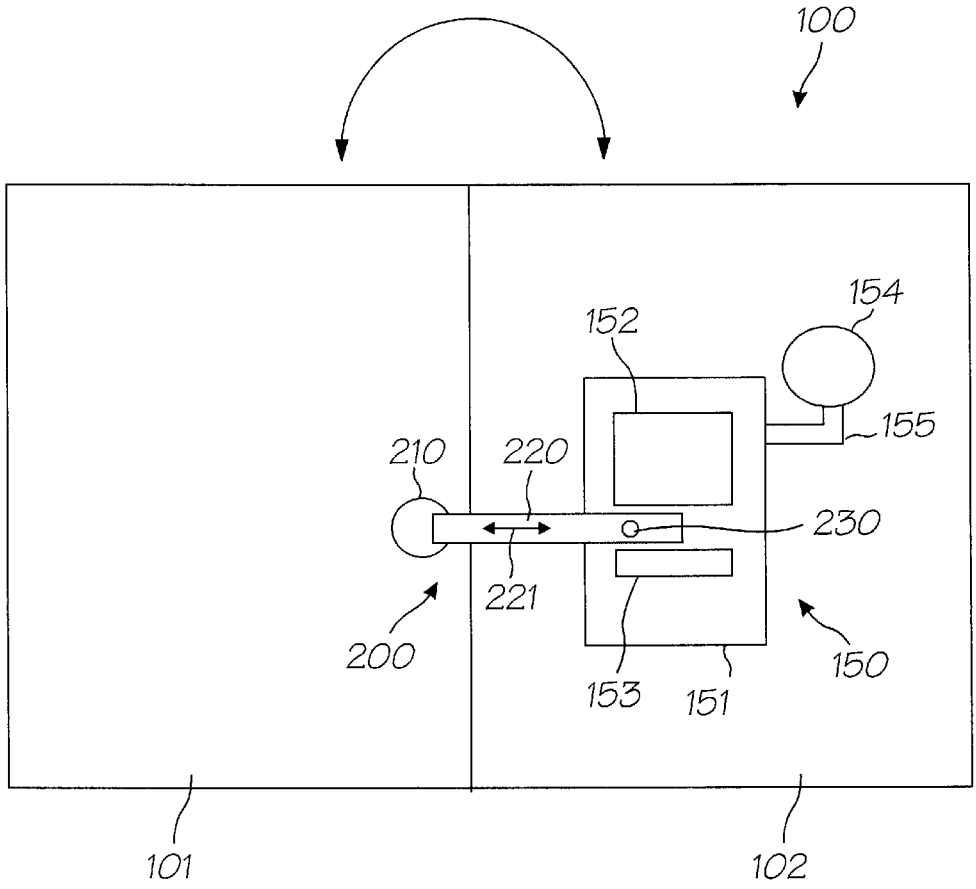
FIG. 7 is a plan view of a third embodiment of an acoustic card.

FIG. 7 shows a permanent magnet 230 attached to a distal end of a plastic pin 220 while the proximal end of plastic pin 220 is connected to a coupler 210 affixed to first flap 101. Plastic pin 220 moves in a direction of a solid arrow 221 in response to the alternate unfolding and folding of first and second flaps 101, 102 of acoustic card 100. Plastic pin 220 is not extended over a top surface of reed switch 153, but extends adjacent to a side of reed switch 153. The top surface of reed switch 153 is parallel to the surface of second flap 102 while the side of reed switch 153 has an angle, with or is perpendicular to, the surface of second flap 102. Permanent magnet 230 is spaced apart from the side of reed switch 153 by a predetermined displacement, is drawn along the side of reed switch 153 by the movement of plastic pin 220 when first and second flaps 101, 102 of acoustic card 100 are alternately folded and unfolded into the open position and the closed position.

Figure 8:
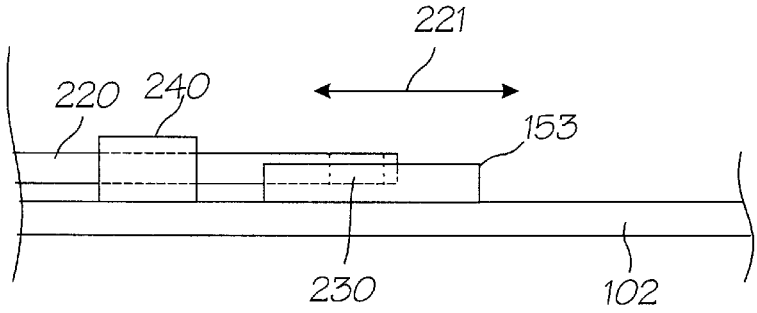
FIG. 8 is a partial side view of the embodiment illustrated by FIG. 7.
Figure 9:
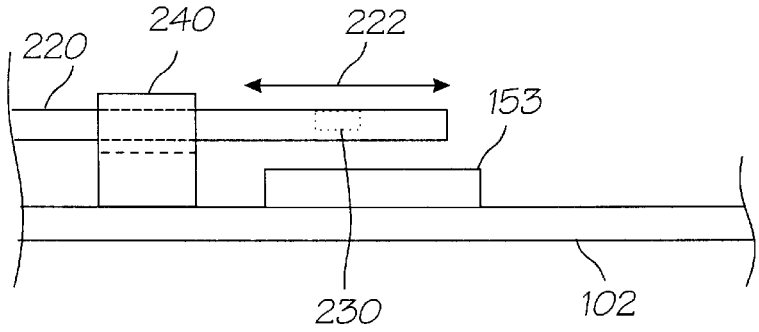
FIG. 9 is a partial side view of a fourth embodiment of an acoustic card.

In FIG. 8, plastic pin 220 is extended along the side of magnetic reed switch 153, and permanent magnet 230 moves along the side of reed switch 153 in a direction 221. As is shown by FIG. 9, plastic pin 220 is extended over and along the top surface of reed switch 153, and permanent magnetic 230 moves over and along the top surface of reed switch 153 in a direction 222.

Figure 10:
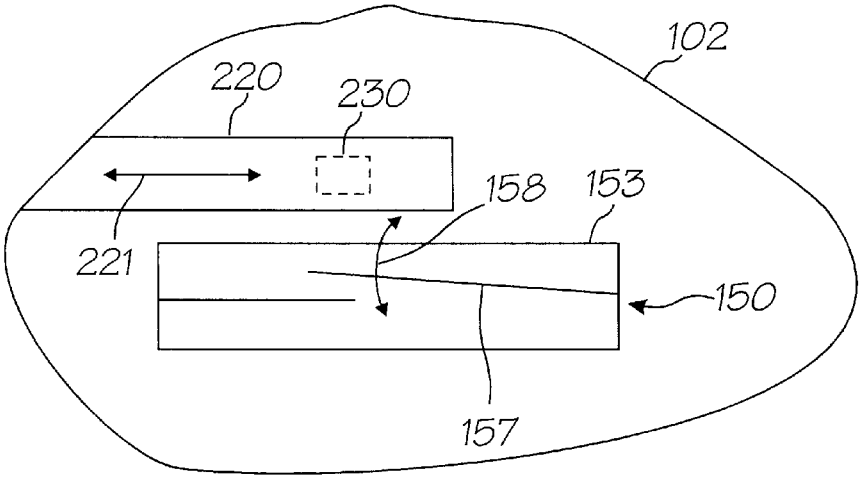
FIG. 10 is a partial plain view showing the movement by a reed of a reed switch in response to movement of a magnet incorporated into the embodiment illustrated by FIG. 7.
Figure 11:
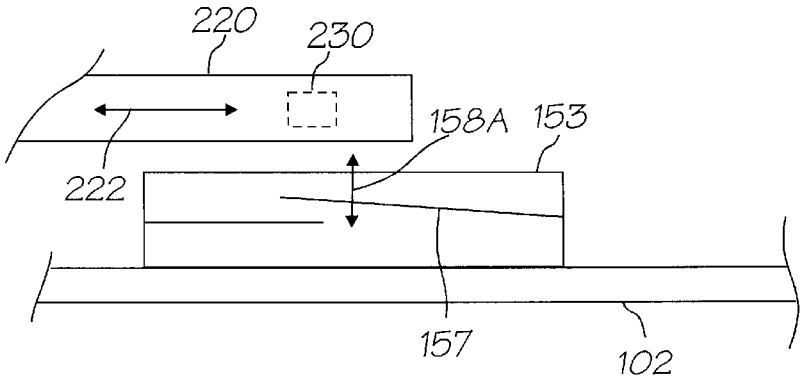
FIG. 11 is a partial side view showing the movement by a reed of a reed switch in response to movement of a magnet incorporated into the embodiment illustrated by FIG. 9.

The electrical reed contact of 157 within reed switch 153 moves along the side of reed switch 153 in the direction 158 parallel to the surface of second flap 102 while maintaining the predetermined distance as shown in FIG. 10. If plastic pin 220 is extended over the top surface of reed switch 153 as shown in FIG. 9, reed 157 moves in the direction 158A perpendicular to the surface of second flap 102 as shown in FIG. 11.

When first and second flaps 101, 102 of acoustic card 100 are folded into their closed mutually positions, permanent magnet 230 is spaced apart from reed switch 153 by a first predetermined distance where reed 157 of reed switch 153 is located within the magnetic field of permanent magnet 230. Subsequently, when first and second flaps 101, 102 of acoustic card 100 are unfolded into their open positions, permanent magnet 230 moves away from reed switch 153 by a second predetermined distance where reed 157 of reed switch 153 is not located within the magnetic field of permanent magnet 230. In any case of unfolding and folding first and second flaps 101, 102 of acoustic card 100 into the open position and the closed position, permanent magnet 230 does not directly contact reed 157 of reed switch 153.

As mentioned above, with the acoustic card having a permanent magnet and a reed switch constructed by the principle of the present invention, the acoustic card is durable and prevented from malfunction caused by distortion and abrasion of the acoustic card since no direct contact is made between the permanent magnet and the reed of the reed switch. Moreover, since the permanent magnet moves along the side of reed switch, the thickness of the acoustic card can be reduced.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. An acoustic card, comprising:

a first flap and a second flap joined together along a fold that accommodates rotation of the first flap relative to the second flap between a closed position and unfolded in an open position;

an electrically powered sound generator;

a speaker driven by said sound generator to broadcast audio messages;

a reed switch attached to said second flap, to actuate said sound generator to drive said speaker; and a magnet attached to said first flap, being moved to a position that is operatively disposed adjacent to said reed switch to turn off said sound generator when said first flap and said second flap of said acoustic card are in said closed position.

2. The acoustic card of claim 1, with said magnet comprising:

a permanent magnet; and a cover affixing said permanent magnet to said first flap.

3. The acoustic card of claim 1, with said magnet comprising;

a pin having one end attached to said first flap and having the other end extended over said reed switch; and a permanent magnet attached to said the other end of said pin.

4. The acoustic card of claim 3, with said pin moving in a direction parallel to said reed switch when said first flap and second flap moves between the closed position and the open position.

5. The acoustic card of claim 4, with said permanent magnet moving toward and away from said reed switch when said pin moves in said direction.

6. The acoustic card of claim 1, with said magnet disposed on a surface of said second flap and disposed adjacent to a side of said reed switch in the closed position, said side of said reed switch being perpendicular to said surface of said second flap.

7. The acoustic card of claim 1, with said magnet moving toward said reed switch when said first flap and said second flap are in the closed position while moving away from said reed switch when said first flap and said second flap are in the open position.

8. The acoustic card of claim 1, with said reed switch comprising a reed moving in a direction perpendicular to a flat surface of said second flap.

9. The acoustic card of claim 1, with said reed switch comprising a reed moving in direction parallel to a substantially flat surface of said second flap.

10. The acoustic card of claim 1, with said magnet disposed adjacent to said reed switch so that said reed switch is located within magnetic field generated from said magnet in the closed position of said first flap and said second flap.

11. An acoustic card having a sound generator, comprising:

said acoustic card having a first flap and a second flap, moving between a closed position and an open position;

a reed switch attached to said second flap; and a magnet attached to said first flap, operatively influencing said reed switch and interrupting emanation of sound from the sound generator by traveling to a location disposed adjacent to said reed switch when said acoustic card is in the closed position.

12. The acoustic card of claim 11, with said magnet comprising:

a permanent magnet; and a cover affixing said permanent magnet to said first flap.

13. The acoustic card of claim 12, with said magnet disposed adjacent to said reed switch so that said reed switch is located within magnetic field generated from said magnet in the closed position of said first flap and said second flap.

14. The acoustic card of claim 11, with said magnet comprising;

a pin having one end attached to said first flap and having the other end extended over said reed switch; and a permanent magnet attached to said the other end of said pin.

15. The acoustic card of claim 14, with said pin moving in a direction parallel to said reed switch when said first flap and second flap moves between the closed position and the open position.

16. The acoustic card of claim 11, with said magnet moving toward said reed switch when said first flap and said second flap are in the closed position and moving away from said reed switch when said first flap and said second flap are in the open position.

17. The acoustic card of claim 11, with said reed switch comprising a reed electrode moving in a direction perpendicular to a flat surface of said second flap.

18. The acoustic card of claim 11, with said reed switch comprising a reed electrode moving in direction parallel to a substantially flat surface of said second flap.

19. A process in an acoustic card having a sound generator, comprising the steps of:

providing a magnet attached to a first flap of said acoustic card, disposed adjacent to a reed switch when said acoustic card is in a closed position;

providing said reed switch attached to a second flap;

moving said acoustic card to said closed position for turning off said sound generator and to an open position for turning on said sound generator;

moving said magnet toward said reed switch when said acoustic card moves to said closed position; and moving said magnet away from said reed switch when said acoustic card moves to said open position.

20. The process of claim 19, further comprising the step of moving an electrode of said reed switch in a direction perpendicular to a substantially flat surface of said second flap.

21. The process of claim 19, comprising:

turning on said sound generator for a predetermined period of time when said acoustic card is unfolded to said open position.

* * * * *